US006048267A

United States Patent [19]

Wichinsky

[11] Patent Number: 6,048,267

[45] **Date of Patent: *Apr. 11, 2000**

[54] MULTIPLE HAND STUD POKER GAME

[76] Inventor: Michael Wichinsky, 2575 S. Highland Dr., Las Vegas, Nev. 89109

[ * ] Notice: This patent is subject to a terminal disclaimer.

[21] Appl. No.: 09/167,389

[22] Filed: Oct. 6, 1998

Related U.S. Application Data

[63] Continuation-in-part of application No. 08/838,166, Apr. 16, 1997, Pat. No. 5,816,914.

[51] Int. Cl.[7] ..... A63F 1/00; A63F 9/22

[52] U.S. Cl. ..... 463/13; 273/292

[58] Field of Search ..... 463/13; 273/292, 273/274, 309

[56] References Cited

U.S. PATENT DOCUMENTS

| | | | |
|---|---|---|---|
| 5,356,140 | 10/1994 | Dabrowski et al. | 463/13 |
| 5,732,950 | 3/1998 | Moody | 273/292 |
| 5,816,914 | 10/1998 | Wichinsky | 463/13 |
| 5,868,619 | 2/1999 | Wood et al. | 463/13 |

*Primary Examiner*—Benjamin H. Layno

*Attorney, Agent, or Firm*—John Edward Roethel

[57] ABSTRACT

The player wagers on one or multiple hands and using a single standard fifty-two card deck of playing cards, three cards are dealt face up to each of the player hands. Two cards are then dealt—one face up and one face down—to be used as cards that can be selected by the player for use in the player's hand. The player selects either the face up card or the face down card. The selected card is added to the player's first hand and is displayed face up. The unselected card is then discarded. Two more cards are dealt—one card face up and one card face down. The player again selects either the face up card or the face down card. The selected card is added to the player's second hand and is displayed face up with the unselected card being discarded. Two more cards are dealt—one card face up and one card face down. The player again selects either the face up card or the face down card. The selected card is added to the player's third hand and is displayed face up with the unselected card being discarded. The same procedure is used to add a fifth card to each of the player's hands. This results in the player having three complete five card hands. The amount won by the player is based on the amount wagered by the player and the poker ranking of the player's hand based on a payout schedule.

10 Claims, 10 Drawing Sheets

| | 1st COIN | 2nd COIN | 3rd COIN | 4th COIN | 5th COIN |
|---|---|---|---|---|---|
| ROYAL FLUSH | 500 | 1000 | 1500 | 2000 | PROG. |
| STRAIGHT FLUSH | 125 | 250 | 375 | 500 | PROG. |
| 4 OF A KIND | 20 | 40 | 60 | 80 | 100 |
| FULL HOUSE | 9 | 18 | 27 | 36 | 45 |
| FLUSH | 7 | 14 | 21 | 28 | 35 |
| STRAIGHT | 5 | 10 | 15 | 20 | 25 |
| 3 OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |
| HIGH HAND | ADVANCES PROGRESSIVE AMOUNTS | | | | |

| | 1st COIN | 2nd COIN | 3rd COIN | 4th COIN | 5th COIN |
|---|---|---|---|---|---|
| ROYAL FLUSH | 500 | 1000 | 1500 | 2000 | PROG. |
| STRAIGHT FLUSH | 125 | 250 | 375 | 500 | PROG. |
| 4 OF A KIND | 20 | 40 | 60 | 80 | 100 |
| FULL HOUSE | 9 | 18 | 27 | 36 | 45 |
| FLUSH | 7 | 14 | 21 | 28 | 35 |
| STRAIGHT | 5 | 10 | 15 | 20 | 25 |
| 3 OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |
| HIGH HAND | ADVANCES PROGRESSIVE AMOUNTS | | | | |

| | 1st COIN | 2nd COIN | 3rd COIN | 4th COIN | 5th COIN |
|---|---|---|---|---|---|
| ROYAL FLUSH | 500 | 1000 | 1500 | 2000 | PROG. |
| STRAIGHT FLUSH | 125 | 250 | 375 | 500 | PROG. |
| 4 OF A KIND | 20 | 40 | 60 | 80 | 100 |
| FULL HOUSE | 9 | 18 | 27 | 36 | 45 |
| FLUSH | 7 | 14 | 21 | 28 | 35 |
| STRAIGHT | 5 | 10 | 15 | 20 | 25 |
| 3 OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |
| HIGH HAND | ADVANCES PROGRESSIVE AMOUNTS | | | | |

| | 1st COIN | 2nd COIN | 3rd COIN | 4th COIN | 5th COIN |
|---|---|---|---|---|---|
| ROYAL FLUSH | 500 | 1000 | 1500 | 2000 | PROG. |
| STRAIGHT FLUSH | 125 | 250 | 375 | 500 | PROG. |
| 4 OF A KIND | 20 | 40 | 60 | 80 | 100 |
| FULL HOUSE | 9 | 18 | 27 | 36 | 45 |
| FLUSH | 7 | 14 | 21 | 28 | 35 |
| STRAIGHT | 5 | 10 | 15 | 20 | 25 |
| 3 OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |
| HIGH HAND | ADVANCES PROGRESSIVE AMOUNTS | | | | |

MULTIPLE HAND STUD POKER GAME

CROSS REFERENCE TO RELATED APPLICATION

This application is a Continuation-in-Part of application Ser. No. 8/838,166, filed Apr. 16, 1997, entitled "Method of Playing a Stud Poker Game", now U.S. Pat. No. 5,816,914.

This invention relates to a stud poker game, and more particularly to a stud poker game in which the player is provided with the opportunity to play multiple hands and in which the player can select between a face up card and a face down card to complete each of the multiple player hands. If any or all of the player's completed hands achieves a preselected poker hand ranking, the player wins with the amount of the winnings being based on a payout table and the amount of the player's wagers.

BACKGROUND OF THE INVENTION

There have been many types of electronic video poker gaming machines that have been developed over the years, some of the poker games being stud poker games and some being draw poker games. Each electronic video poker gaming machine is designed to replicate the play of a hand of poker. In some of the embodiments of these games, the player is not playing against any other players or against a dealer's hand; the player is simply attempting to achieve the highest ranking poker hand possible from the cards displayed to the player. The higher the poker hand achieved by the player, the greater the player's winnings based on the number of coins, tokens or credits wagered by the player.

In other embodiments of these games, the player plays his hand against a dealer's hand with the higher hand winning based on conventional poker hand rankings. If the player's hand beats the dealer's hand, the player wins and the higher the poker hand achieved by the player when the player has a winning hand, the greater the player's winnings based on the number of coins, tokens or credits wagered by the player.

The forerunner of all electronic video poker gaming machines is the video Draw Poker machine that deals cards from a standard 52 card poker deck and displays a single five card hand to the player. This is a conventional "player's hand only" game since the player does not play against a dealer's hand, but is only trying to achieve the highest poker hand ranking he can for the player's hand. After the cards are electronically shuffled and an initial deal of five cards is displayed to the player, the player then selects which of the five cards he wishes to hold. The draw poker machine then displays replacement cards for the cards the player has discarded. The player wins or loses based on conventional poker hand rankings for the resulting five card hand. A payout table is established based on the number of coins, tokens or credits wagered by the player (credits can be wagered by the player if the gaming machine has a credit meter that accrues credits earned by the player during the play of the game) and the type of poker hand achieved.

Table 1 shows a typical payout schedule that can be used in electronic video draw poker machines of the "player's hand only" type.

TABLE 1

| | NUMBER OF COINS PLAYED | | | | |
|---|---|---|---|---|---|
| TYPE OF HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |

The classic draw poker machine has been modified to use jokers as wild cards or to use deuces (or even other cards) as wild cards. "Joker's Wild" and "Deuces Wild" draw poker still display to the player a single five card hand and allow the player to discard unwanted cards and receive replacement cards. The payout table is modified to recognize the differing odds for achieving various poker hands when wild cards are involved.

Other types of "player's hand only" poker games have been adapted to run on electronic video gaming machines. In the electronic version of "player's hand only" seven card stud poker, the player wagers one or more coins, tokens or credits to be eligible to play the game and the player is dealt three cards initially. The player then has the option of folding in which case he loses his initial wager or betting additional coins, tokens or credits to receive additional cards. Eventually the player has either folded or received a full seven card hand. The player wins or loses based on conventional poker hand rankings for the best five cards of his seven card hand. A payout table is established based on the number of coins, tokens or credits wagered by the player and the type of poker hand achieved.

In the electronic version of "player's hand only" five card stud poker, the player wagers one or more coins, tokens or credits to be eligible to play the game and the player is dealt four cards initially. The player then has the option of staying or betting additional coins, tokens or credits to increase the amount of a winning payout when he receives the fifth card. After the fifth card is dealt to the player, the value of his five card hand is determined based on conventional poker hand rankings for his five card hand. A payout table is established based on the number of coins, tokens or credits wagered by the player and the type of poker hand achieved.

Some of the poker card games adapted to electronic video gaming machines display both the player's hand and a dealer's hand. This occurs in those games where the player must beat the dealer in order to win.

One example of these combined "player's hand/dealer's hand" games is CARIBBEAN STUD® poker. This game is described in U.S. Pat. No. 4,886,553, the disclosure of which is incorporated herein by reference.

Because of the proliferation of legalized gaming, the competition for players has increased. Operators of gaming machines have been increasing the payback percentage to attract players and the increase of the gaming percentage has resulted in a lowering of profits to the operators. There is a demand in the market for new gaming machines that create a higher volume of play so that profits can be increased even with the higher payback percentages that the players desire.

It is an object of the present invention to provide a stud poker game that uses multiple partial player hands and then uses a card selection procedure to complete each of the partial hands.

It is a feature of the present invention that multiple groups of three cards are dealt face up as the player hands. Two additional selection cards are dealt—one face up and one face down. The player selects either the face up card or the face down card to be added to the first player's hand. The non-selected card is discarded. Again, two selection cards are dealt—one face up and one face down and the player selects either the face up card or the face down card to be added to the second player's hand. The non-selected card is again discarded. Again, two selection cards are dealt—one face up and one face down and the player selects either the face up card or the face down card to be added to the third player's hand. Once each of the player's hands have four cards, the procedure is repeated until each of the player's hands have five cards. Each of the resulting five card hands are analyzed to determine the poker hand ranking of each five card hand. Depending on the poker hand ranking of each hand, the player wins or loses on each hand. If the player wins, the player's winning amount is based on a payout schedule and the amount wagered by the player on the winning hand.

It is an advantage of the present invention that video poker players are provided with a new, exciting and creative five card stud game. The method of play requires skill on the part of the player with the potential for high payouts of either fixed or progressive amounts.

Other objects, features and advantages of the present invention will become apparent from a consideration of the following detailed description.

SUMMARY OF THE INVENTION

The game of the present invention is displayed on an electronic video gaming machine. The player wagers on one or multiple hands (such as three hands) that the player wishes to play. Using a single standard fifty-two card deck of playing cards, three cards are dealt face up to each of the player hands. Two cards are then dealt—one face up and one face down—to be used as cards that can be selected by the player for use in the player's hand. The player selects either the face up card or the face down card. The selected card is added to the player's first hand and is displayed face up. The unselected card is then discarded. Two more cards are dealt—one card face up and one card face down. The player again selects either the face up card or the face down card. The selected card is added to the player's second hand and is displayed face up with the unselected card being discarded. Two more cards are dealt—one card face up and one card face down. The player again selects either the face up card or the face down card. The selected card is added to the player's third hand and is displayed face up with the unselected card being discarded.

The same procedure is used to add a fifth card to each of the player's hands. This results in the player having three complete five card hands. Each of the resulting five card hands are analyzed to determine its poker hand ranking.

When played as an electronic video casino game, the amount won by the player is based on the number of coins, tokens or credits wagered by the player and the poker ranking of the player's hand. A payout schedule is provided with the highest hand being a Royal Flush.

DETAILED DESCRIPTION OF THE PREFERRED EMBODIMENTS

Figure 1:
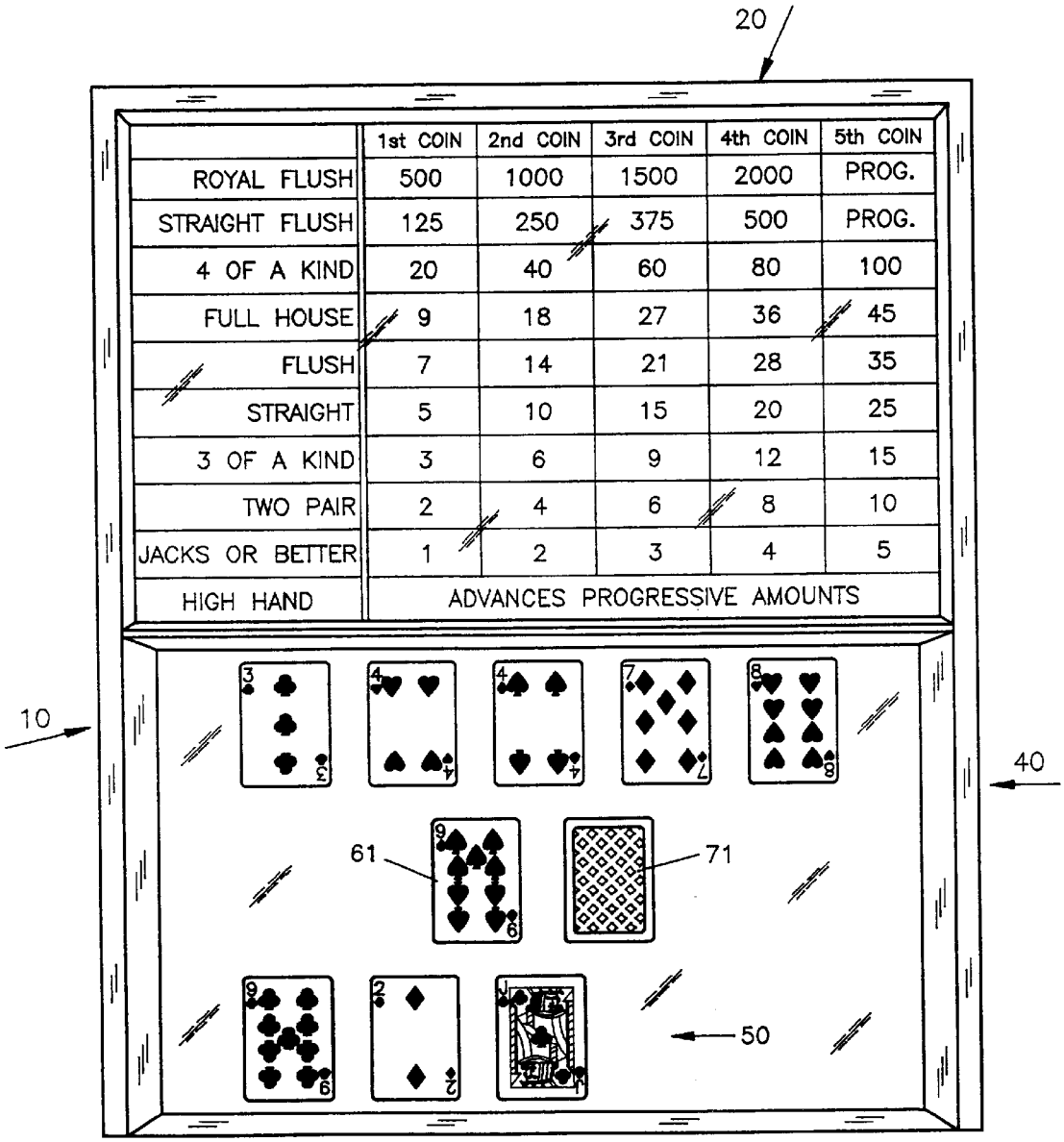
FIG. 1 shows schematically a pay table and a video display on an electronic video gaming machine of the method of play of the present invention after the dealer's hand has been dealt, the first three cards of the player's hand have been dealt and before the player has selected his fourth card.

The method of the present invention is preferably displayed on an electronic video gaming machine of the type used to display video draw poker and other similar games. As shown in FIG. 1, the electronic video gaming machine 10 comprises a pay table 20, preferably located on the front of the gaming machine above the video display, and a video display screen 30.

The present invention requires a screen display that is capable of showing both the dealer's hand 40 and the player's hand 50 as well as two additional card locations, the face up card location 61 and the face down card location 71.

The method of the present invention uses a single fifty-two card deck of standard playing cards. At the beginning of each round of the game, all of the cards are electronically shuffled. The player makes a wager to participate in the play of the game. The wager can be one or more coins, tokens or accrued credits as is conventional. In the preferred embodiment, the player wagers one to five coins, tokens or credits with the highest payouts being provided for the maximum wager of five coins, tokens or credits so as to encourage players to make the maximum wager.

After the player has made his wager, the game is activated by the player pressing a "Deal" button as is conventional. As is also conventional, if the player makes the maximum wager, the game activates automatically.

Initially, as shown in FIG. 1, five cards are displayed face up as the "Dealer's Hand" 40. A representative deal of the dealer's hand 40 is shown in FIG. 1 and the dealer has received the 3♧, 4♡, 4♤, 7♢ and 8♡. The dealer's hand has a pair of 4's as the highest poker hand ranking.

After the dealer's hand is dealt and displayed on the video screen 30, the first three cards of the player's hand 50 are dealt. A representative deal of the first three cards of the player's hand 50 is shown in FIG. 1 and the player has received the 9♧, 2♢ and J♧.

After the first three cards of the player's hand have been dealt, two selection cards 61 and 71 are dealt and displayed as cards to be used by the player to complete the player's hand. The selection cards are displayed one card face up 61 (which as shown in FIG. 1 is a 9♤) and one card face down 71.

The player selects either the face up card 61 or the face down card 71 and the selected card is then displayed in the player's hand as the player's fourth card. The non-selected card is then removed from the screen and is no longer available to be used in the game. As an alternative method of practicing the invention, the non-selected card can be left on the screen and only a replacement card is dealt for the card that has been selected and moved to the player's hand.

Figure 2:
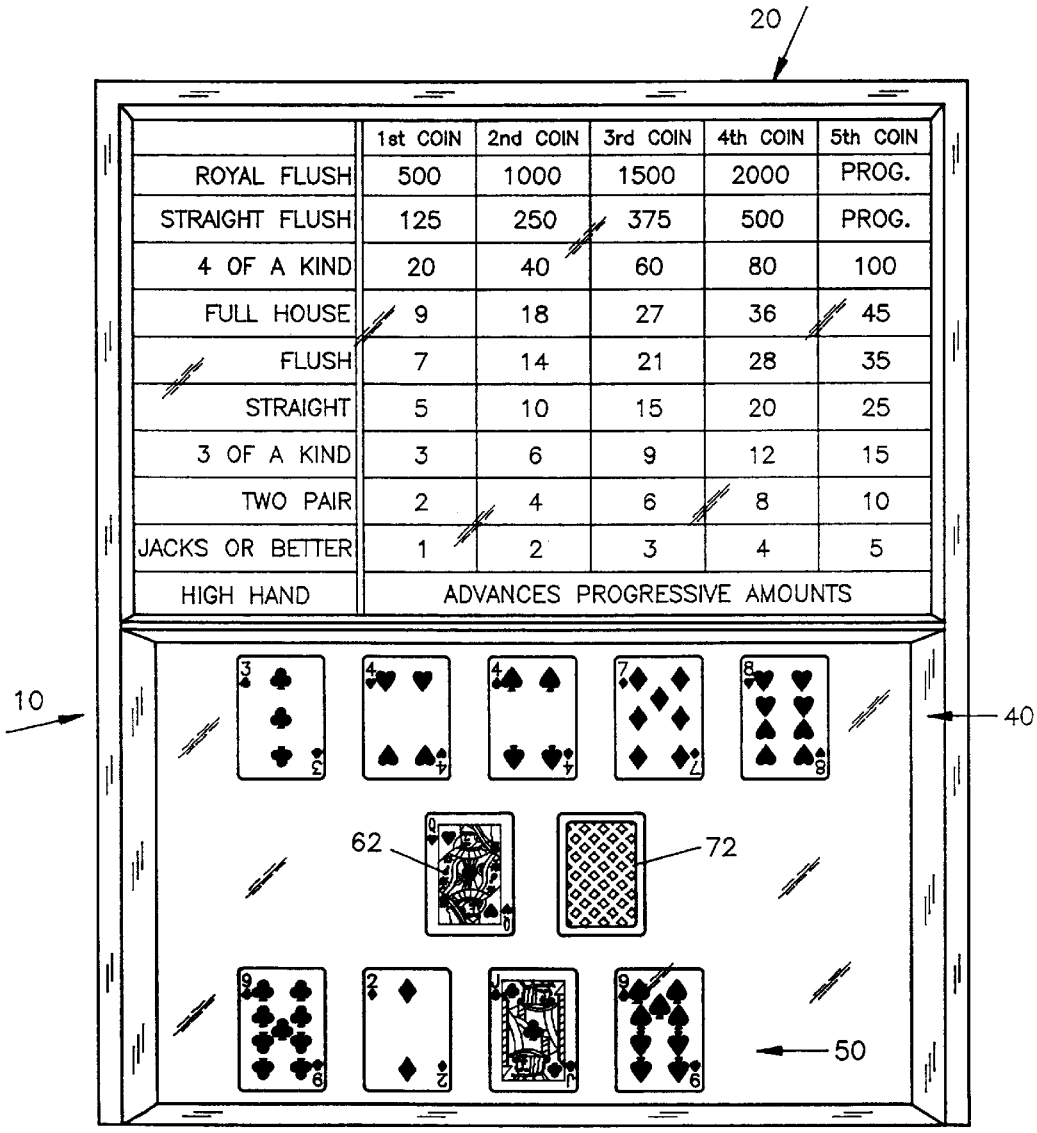
FIG. 2 shows schematically a pay table and a video display on an electronic video gaming machine of the method of play of the present invention after the player has selected his fourth card and before the player has selected his fifth card.

As shown in FIG. 2, the player has selected the face up card 61 (the 9♤) and this card is moved to the fourth position in the player's hand 50. Then, two more selection cards are then displayed, one face up 62 (the Q♡) and one face down 72. The player again selects either the face up card or the face down card and the selected card is displayed in the player's hand as the player's fifth and final card.

Figure 3:
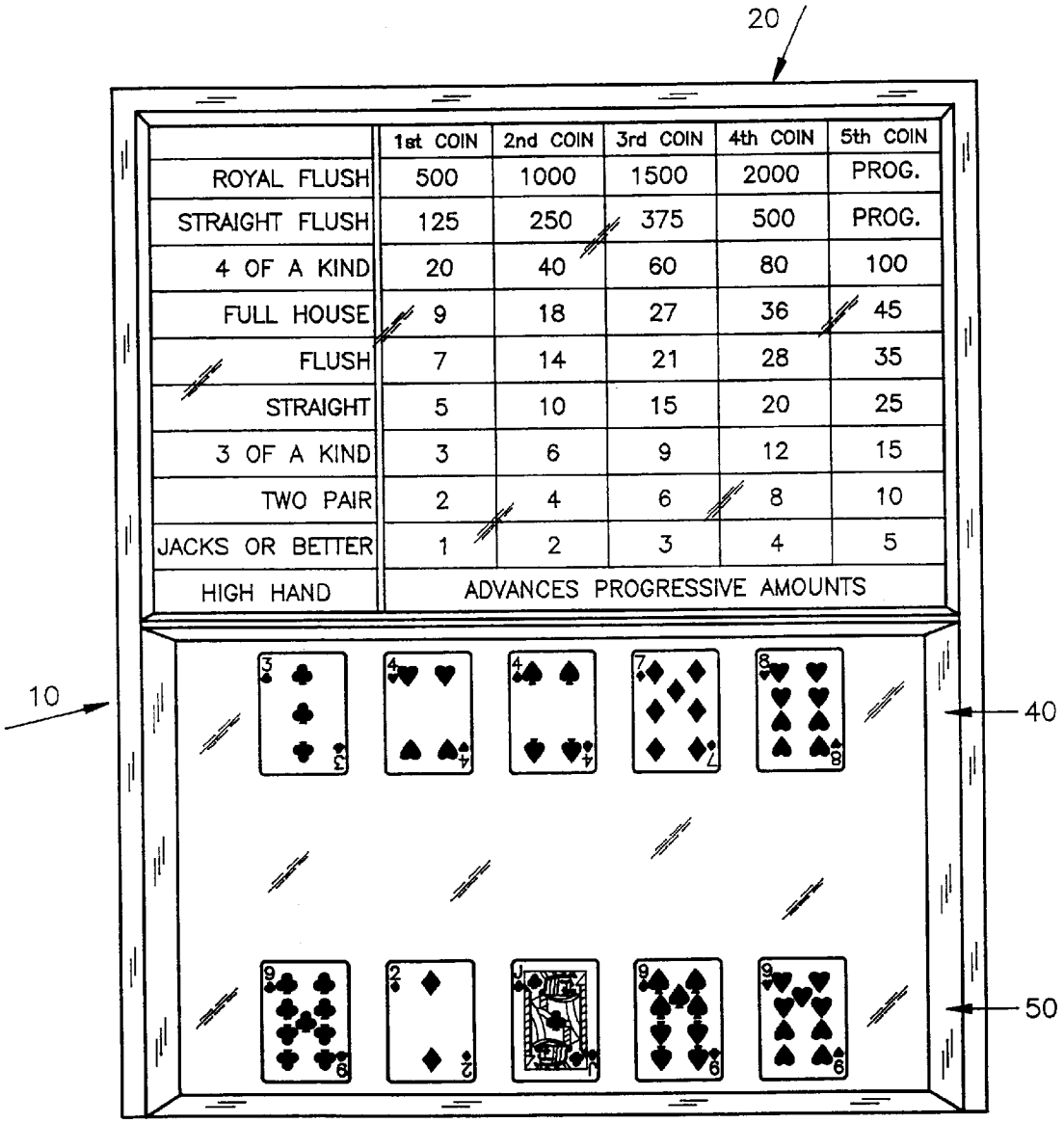
FIG. 3 shows schematically a pay table and a video display on an electronic video gaming machine of the method of play of the present invention after the player has selected his complete five card hand.

As shown in FIG. 3, the player selected the face down card 72 which turned out to be the 9♡ which is moved to the fifth position in the player's hand 50 giving the player three 9's. The non-selected card is then removed from the screen and is no longer available to be used in the game.

At this point, both the player's hand and the dealer's hand are displayed on the screen and each hand comprises five cards all face up. Whichever hand is the higher hand according to poker hand rankings is the winning hand. If the dealer's hand is the higher hand, then the player loses his wager, the game is over and the player may engage in another round of the game.

If the player's hand is the higher hand, the player is the winner and the player receives a payout based on a payout schedule according to the number of coins, tokens or credits wagered by the player. In the example shown in drawings, the player's hand of three 9's beats the dealer's hand of a pair of 4's, so the player wins.

A typical payout schedule that can be used in the method of the present invention is shown in Table 2.

TABLE 2

| TYPE OF HAND | NUMBER OF COINS PLAYED | | | | |
|---|---|---|---|---|---|
| PLAYER'S WINNING HAND | 1 | 2 | 3 | 4 | 5 |
| ROYAL FLUSH | 500 | 1000 | 1500 | 2000 | Prog. |
| STRAIGHT FLUSH | 125 | 250 | 375 | 500 | Prog. |
| FOUR OF A KIND | 20 | 400 | 600 | 800 | 100 |
| FULL HOUSE | 9 | 18 | 27 | 36 | 45 |
| FLUSH | 7 | 14 | 21 | 28 | 35 |
| STRAIGHT | 5 | 10 | 15 | 20 | 25 |
| 3 OF A KIND | 3 | 6 | 9 | 12 | 15 |
| 2 PAIRS | 2 | 4 | 6 | 8 | 10 |
| ANY PAIR | 1 | 2 | 3 | 4 | 5 |
| HIGH CARD HAND | Advances Progressive Amounts | | | | |

Again with reference to the example shown in the drawings, the player would win on the "3 Of A Kind" row with the winning amount being based on the number of coins, tokens or credits wagered by the player, e.g. if the player wagered five coins, tokens or credits, the player would win fifteen coins, tokens or credits in return.

In the payout table shown in Table 2, whenever the player makes a maximum wager of five coins, tokens or credits, the player may win a progressive jackpot amount for either a Royal Flush or a Straight Flush, assuming that the player's hand beats the dealer's hand. The electronic gaming machine 10 can be programmed to increment the progressive amounts according to any pre-established standard desired by the operator of the electronic gaming machine 10. In the preferred embodiment of the present invention, the progressive amount for the Royal Flush and the Straight Flush can be programmed to be incremented whenever the player's hand 50 beats the dealer's hand 40 but the player's hand only has a "High Card" higher the dealer's high card. That is, the player's hand wins with less than any pair.

Other methods of incrementing the progressive jackpot amounts for the Royal Flush and the Straight Flush may be employed. For example, a preselected percentage of each wager made can be applied to the progressive jackpot amounts for the Royal Flush and the Straight Flush. Or a preselected percentage of only the fifth coin wagers can be added to the progressive jackpot amounts for the Royal Flush and the Straight Flush.

Alternatively, either the Royal Flush payout or the Straight Flush payout or both can be made fixed amounts and not progressive jackpot amounts.

Other payout tables can be used depending on the percentage desired to be returned to the player and the percentage desired to be retained by the gaming establishment. Table 3 shows another representative payout table that can be used with the method of the present invention.

TABLE 3

| TYPE OF HAND | NUMBER OF COINS PLAYED | | | | |
|---|---|---|---|---|---|
| PLAYER'S WINNING HAND | 1 | 2 | 3 | 4 | 5 |
| ROYAL FLUSH | 500 | 1000 | 1500 | 2000 | Prog. |
| STRAIGHT FLUSH | 125 | 250 | 375 | 500 | Prog. |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 5 | 10 | 15 | 20 | 25 |
| 3 OF A KIND | 3 | 6 | 9 | 12 | 15 |
| 2 PAIRS | 2 | 4 | 6 | 8 | 10 |
| ANY PAIR | 1 | 2 | 3 | 4 | 5 |
| HIGH CARD HAND | Advances Progressive Amounts | | | | |

Likewise, Table 4 is yet another representative payout table that can be used with the method of the present invention.

TABLE 4

| TYPE OF HAND | NUMBER OF COINS PLAYED | | | | |
|---|---|---|---|---|---|
| PLAYER'S WINNING HAND | 1 | 2 | 3 | 4 | 5 |
| ROYAL FLUSH | 500 | 1000 | 1500 | 2000 | Prog. |
| STRAIGHT FLUSH | 125 | 250 | 375 | 500 | Prog. |
| FOUR OF A KIND | 25 | 500 | 750 | 100 | 125 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| 3 OF A KIND | 3 | 6 | 9 | 12 | 15 |
| 2 PAIRS | 2 | 4 | 6 | 8 | 10 |
| ANY PAIR | 1 | 2 | 3 | 4 | 5 |
| HIGH CARD HAND | Advances Progressive Amounts | | | | |

The method of the present invention can be modified from the manner of play discussed above. For example, the number of cards initially dealt to the player's hand can be varied from the three cards used in the preferred embodiment. For example, four cards, two cards, one card or even no cards can initially be dealt to the player's hand and then the player completes his hand by successively selecting the face up or face down card until the player's hand comprises a full five card hand.

Also, as discussed above, in the preferred embodiment of the present invention, whenever the player selects either the face up card or the face down card to be added to the player's hand, the non-selected card is discarded and removed from the screen and two new selection cards—one face up and one face down—are dealt. Alternatively, however, the non-selected card (whether face up or face down) can be left on the screen and only a replacement card for the selected card is dealt.

FIGS. 4–10 show an alternative embodiment of the present invention in which the player can wager on one or more partial hands of three cards and then select between a face up card and a face down card to complete each of the hands with five cards. In the preferred embodiment of the present invention, the player can wager on one, two or three hands. More than three hands can be provided to the player if the size of the video screen display can accommodate four or more hands.

The method of this alternative version of the present invention is preferably dealt using a single deck of fifty-two playing cards. Alternatively, one or more of the ranks of playing cards can be designated as wild cards or one or more Jokers can be added to the deck and used as wild cards.

Figure 4:
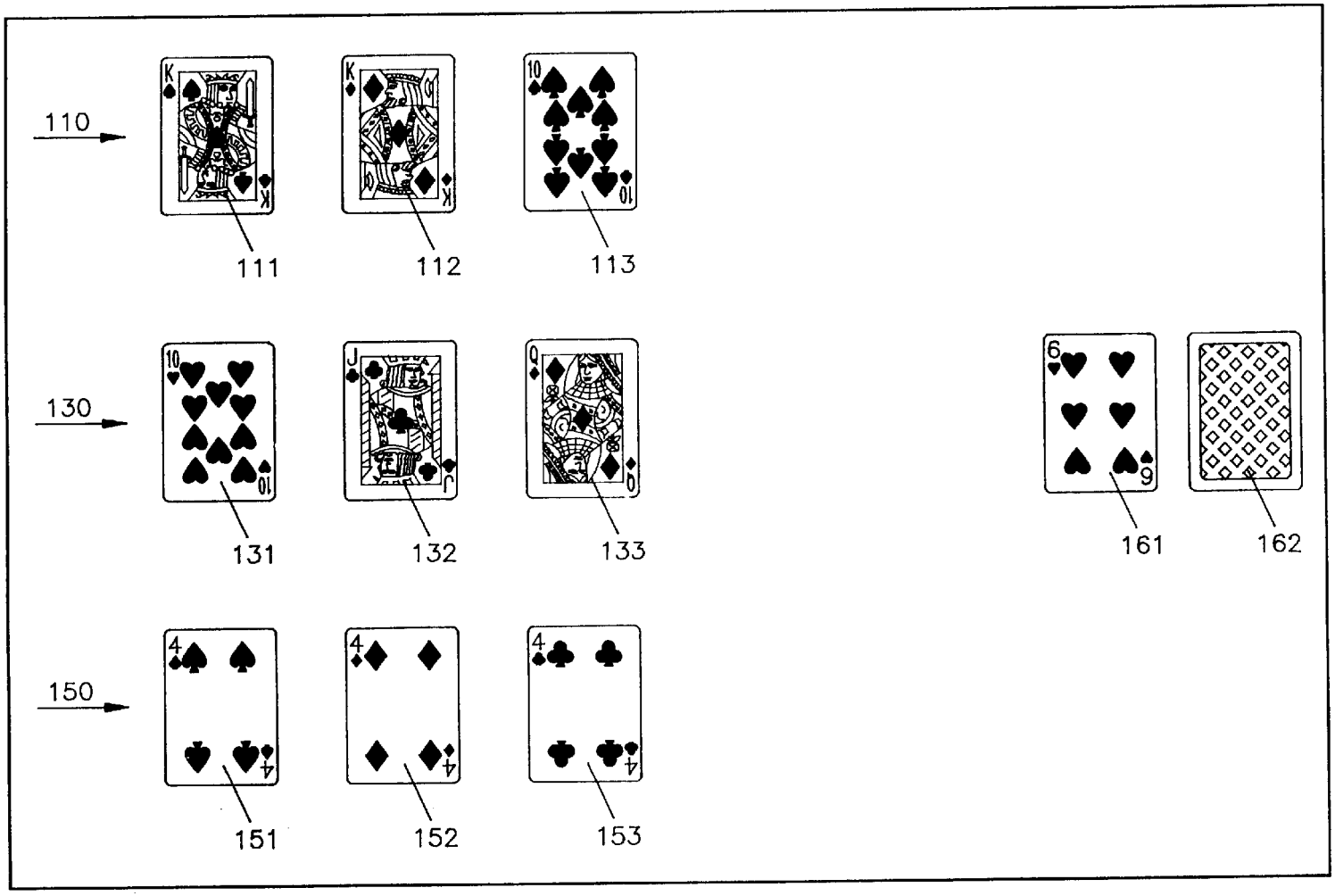
FIGS. 4–10 show video display screens of the method of play of an alternative embodiment of the present invention in which multiple player hands are played.

As shown in FIG. 4, the player has made three wagers which provide the player with three partial hands which the player will play to completion so that three five card hands will be shown. The player can wager any number of coins, tokens or credits on each of the multiple hands. In the preferred embodiment of this version of the present invention, the player would wager one to five coins, tokens or credits on each hand with five coins, tokens or credits being the maximum amount capable of being wagered on each hand. Alternatively, more or less than five coins, tokens or credits can be established as the maximum wager on each hand and the player can be allowed to wager the same amount on each hand or different amounts on each hand.

Once the player has completed his wagering, three cards are dealt to each hand upon which the player has made a wager. As shown in FIG. 4, the player has wagered on three hands so three partial hands of three cards each are dealt and displayed face up to the player. As an example of the method of play, the first hand 110 has received a King of Spades 111, a King of Diamonds 112 and a Ten of Spades 113. The second hand 130 has received a Ten of Hearts 131, a Jack of Clubs 132 and a Queen of Diamonds 133. The third hand 150 has received a Four of Spades 151, a Four of Diamonds 152 and a Four of Clubs 155.

Figure 5:
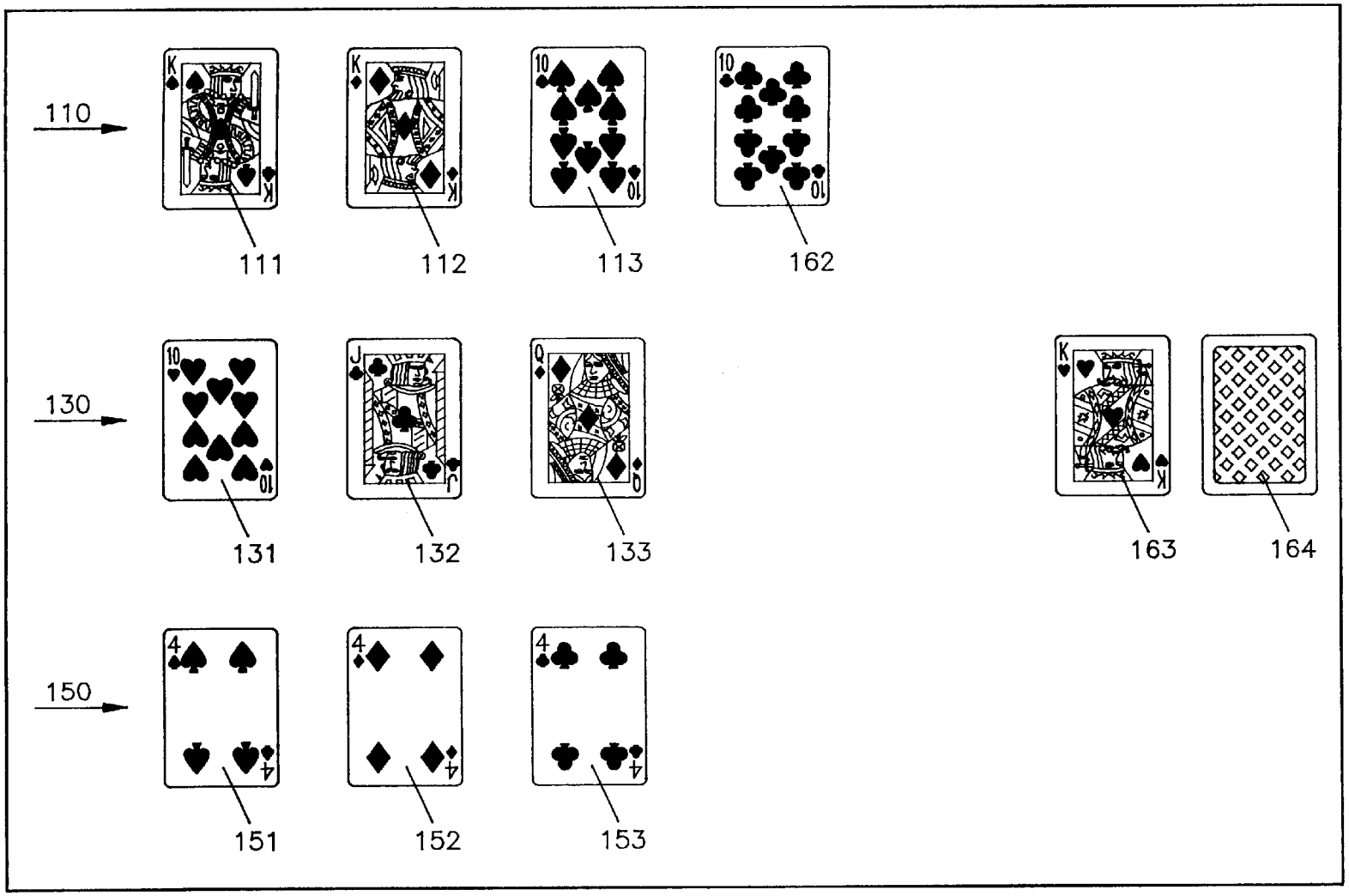

Two selection cards are also displayed to the player—a face up card 161, the Six of Hearts, and a face down card 162. The player selects either the face up card 161 or the face down card 162 to be added to the first hand 110 as the fourth card thereof. In this example as shown in FIG. 5, the player selects the face down card 162 which is then turned face up (the Ten of Clubs) and is added to the first hand 110. The face up card 161 is discarded and is no longer available to be used in the game.

Figure 6:
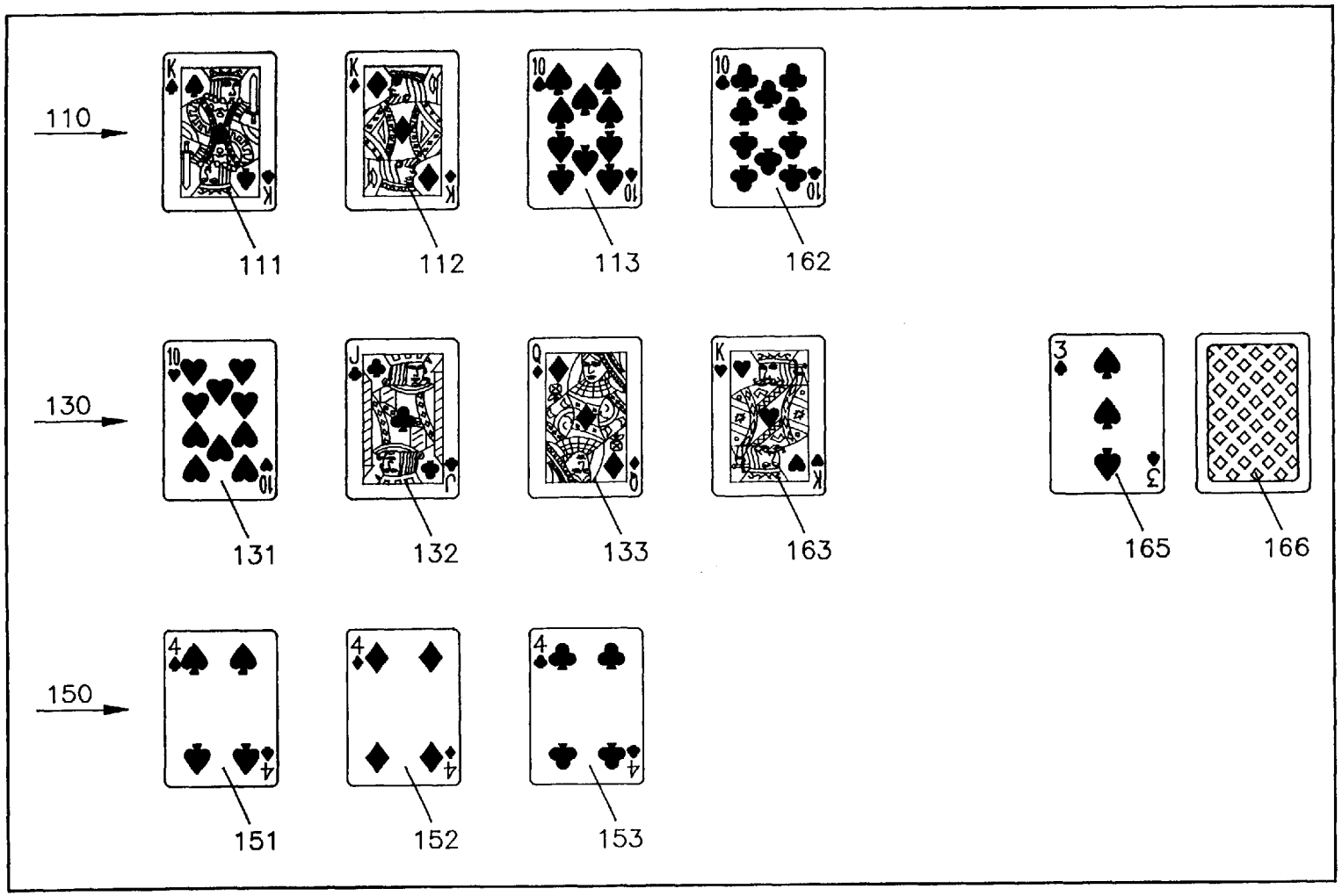

Two different selection cards are now displayed to the player—a face up card 163, the King of Hearts, and a face down card 164. The player selects either the face up card 163 or the face down card 164 to be added to the second hand 130 as the fourth card thereof. In this example as shown in FIG. 6, the player selects the face up card 163 (the King of Hearts) which is then added to the second hand 130. The face down card 164 is discarded and is no longer available to be used in the game.

Figure 7:
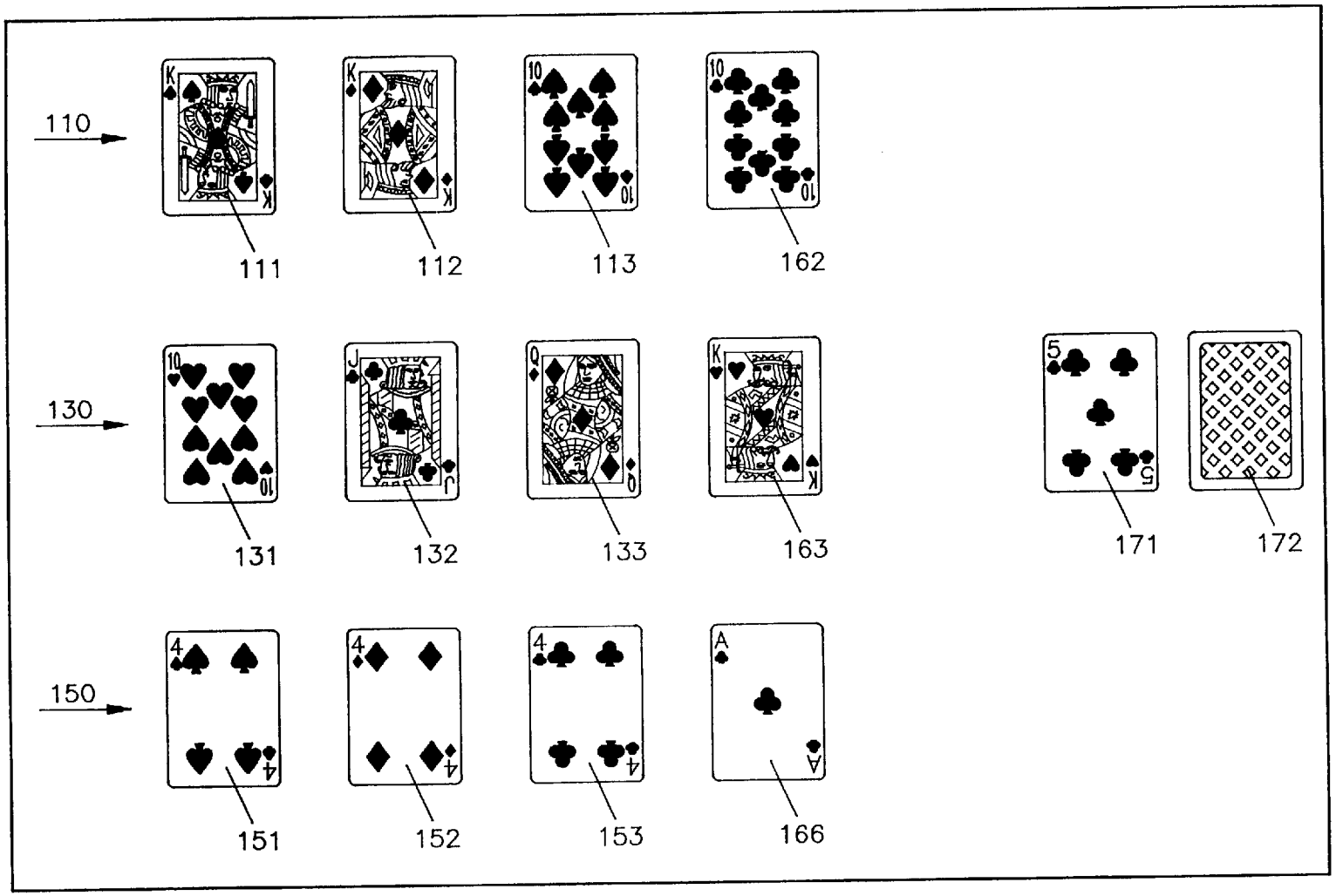

Again as shown in FIG. 6, two different selection cards are now displayed to the player—a face up card 165, the Three of Spades, and a face down card 166. The player selects either the face up card 165 or the face down card 166 to be added to the third hand 150 as the fourth card thereof. In this example as shown in FIG. 7, the player selects the face down card 166 which is then turned face up (the Ace of Clubs) and which is added to the third hand 150. The face up card 165 is discarded and is no longer available to be used in the game.

Each of the three hands wagered on by the player now has four cards. The procedure of the method of play continues so that each hand wagered on by the player is completed to have five cards.

Figure 8:
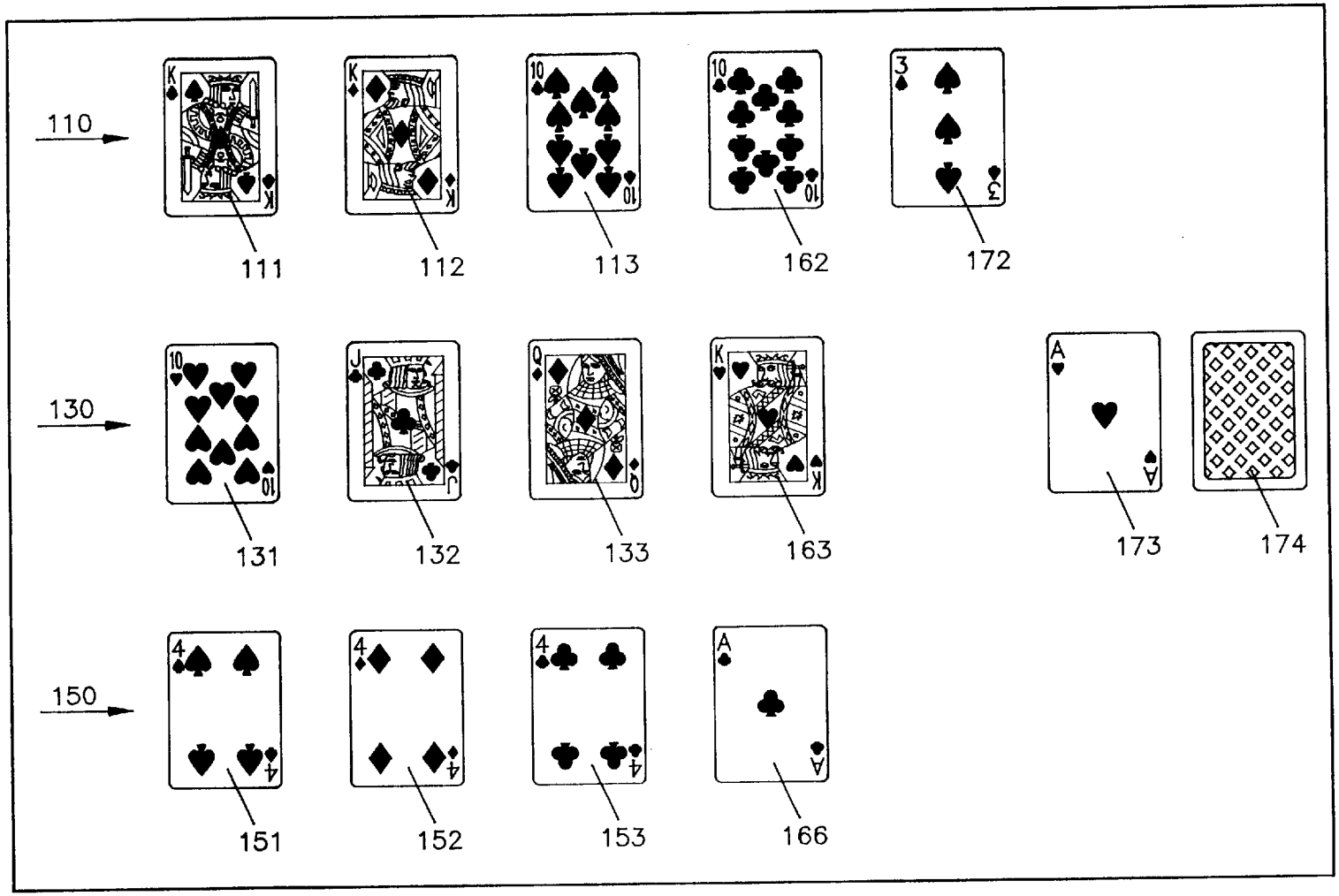

Two more selection cards as shown in FIG. 7 are again displayed to the player—a face up card 171, the Five of Clubs, and a face down card 172. The player selects either the face up card 171 or the face down card 172 to be added to the first hand 110 as the fifth card thereof. In this example as shown in FIG. 8, the player selects the face down card 172 which is then turned face up (the Three of Spades) and is added to the first hand 110. The face up card 171 is discarded and is no longer available to be used in the game.

Figure 9:
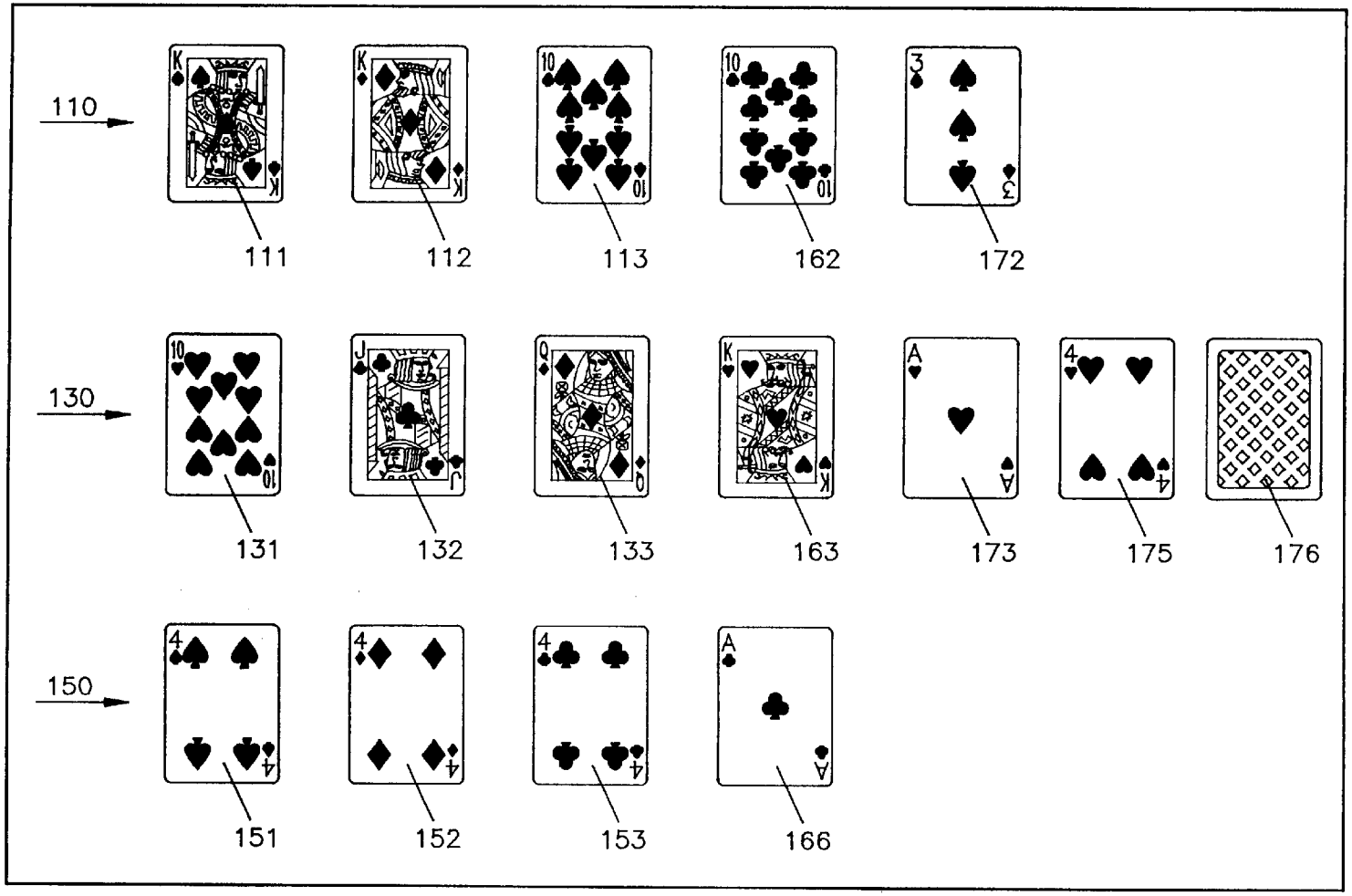

Two different selection cards shown in FIG. 8 are now displayed to the player—a face up card 173, the Ace of Hearts, and a face down card 174. The player selects either the face up card 173 or the face down card 174 to be added to the second hand 130 as the fifth card thereof. In this example as shown in FIG. 9, the player selects the face up card 173 (the Ace of Hearts) which is then added to the second hand 130. The face down card 174 is discarded and is no longer available to be used in the game.

Finally as shown in FIG. 9, two different selection cards are now displayed to the player—a face up card 175, the Four of Hearts, and a face down card 176. The player selects either the face up card 175 or the face down card 176 to be added to the third hand 150 as the fifth card thereof. In this example, the player selects the face up card 175 which is added to the third hand 150. The face down card 176 is discarded and is no longer available to be used in the game.

Figure 10:
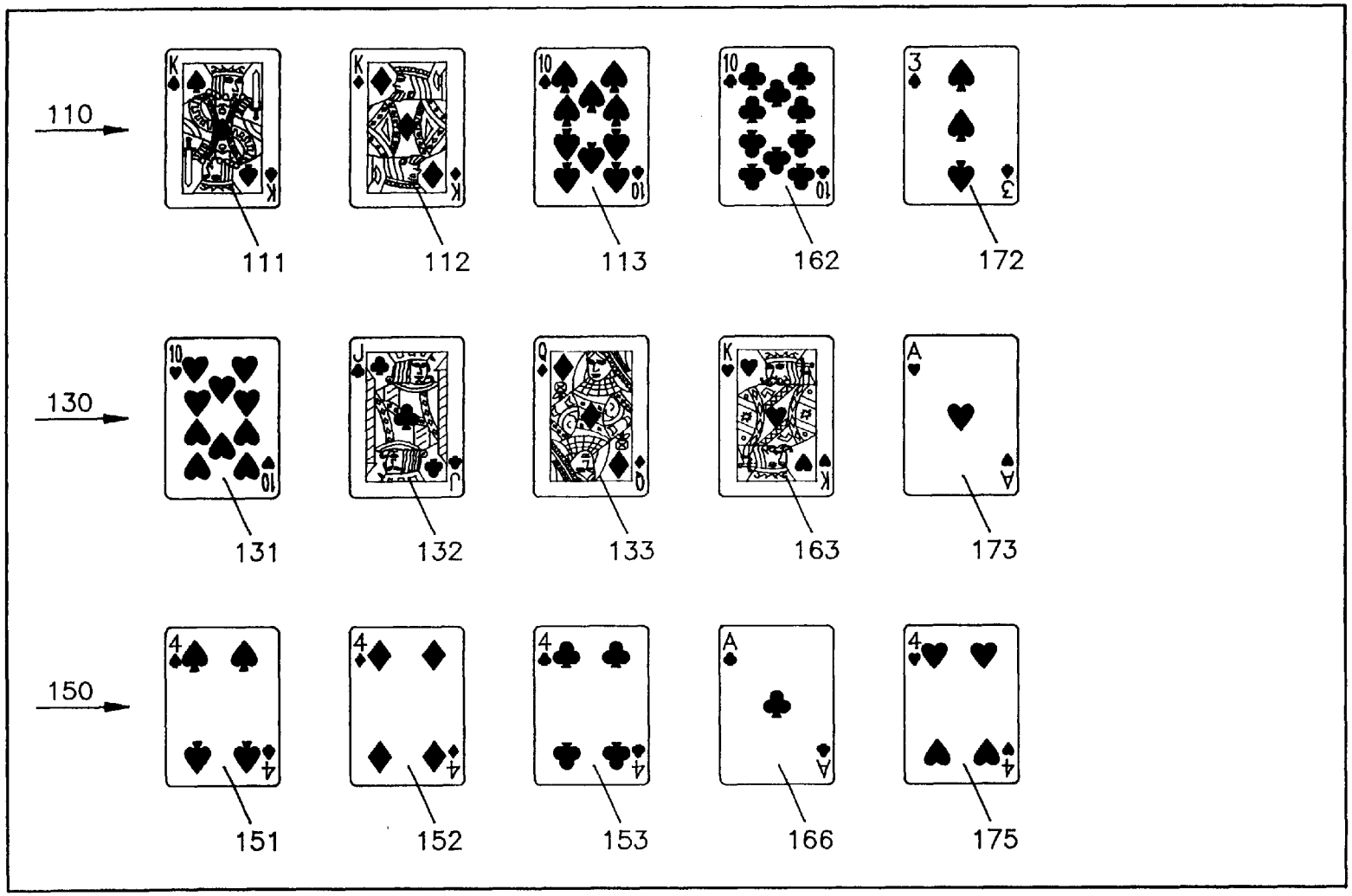

The card selection procedure is now complete since each of the three player hands has five cards as shown in FIG. 10. Each hand is analyzed to determine the poker hand ranking thereof. If the player has achieved a poker hand ranking of the type shown in the pay table accompanying the method of play, then the player has a winning hand. All other poker hand rankings are losing hands.

The amount won by the player is based on the number of coins, tokens or credits wagered by the player and the poker ranking of each of the player's hands. A payout schedule is provided with the highest hand being a Royal Flush.

Any suitable payout schedule can be used. Table 5 shows a representative payout schedule for this alternative version of the present invention.

TABLE 5

| | NUMBER OF COINS PLAYED | | | | |
|---|---|---|---|---|---|
| POKER HAND RANKING | 1 | 2 | 3 | 4 | 5 |
| ROYAL FLUSH | 250 | 500 | 750 | 1000 | 4700 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 7 | 14 | 21 | 28 | 35 |
| STRAIGHT | 5 | 10 | 15 | 20 | 25 |
| THREE OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |

With reference to the pay table of Table 5 and the final five card hands in FIG. 10, the player has achieved three winning hands. If the player has wagered five coins, tokens or credits on each of the three hands, the player would win ten credits for the Two Pair of the first hand 110, twenty-five credits for the Straight of the second hand 130 and one hundred twenty-five credits for the Four of a Kind of the third hand 150. If the player had achieved one or more losing hands, the player would lose his wager on any losing hand.

Other variations can be made be made to the method of play of this alternative embodiment of the present invention.

For example, rather than adding the fourth card to each hand in sequence, the fourth and fifth cards of each hand can be added consecutively before moving on to the next hand.

The method of the present invention can also be practiced by allowing the player to select the completion cards for each hand in any order desired by the player. As each pair of selection cards are dealt, the player can direct either the face up card or the face down card to any hand that still needs a card to be a complete five card hand. As each hand becomes complete with five cards, the player is then restricted to the remaining uncomplete hands as location for selected cards until all of the hands wagered on by the player are completed with five cards. Whenever the player selects a card from between the face up card and the face down card, the non-selected card is discarded and is no longer available to be used in the game.

In yet another variation of the method of play of the present invention, the player is required to fold any hand that the player wishes to skip when it is the turn for that hand to receive a card. For example, if it is the turn of the first hand to receive a card, but the player wishes to place a selected card in the second hand, the player must fold the first hand in order to be able to skip the first hand and place a selected card in the second hand. Likewise, if the player wishes to skip the second hand when it would the turn of the second hand to receive a selected card, the player must fold the second hand in order to place a selected card in the third hand.

As shown in FIGS. 4–10, each partial hand is dealt with three cards face up and the remaining two cards are selection cards. Alternatively, the partial hand could have one, two or four cards dealt face up with the remaining cards being selection cards chosen by the player in the manner described until each hand has a complete hand of five cards.

While each of the versions of the present invention have been described with reference to an electronic video gaming machine format, it is also possible to practice the method of the present invention in a live gaming table format in which a dealer shuffles the cards and deals to the players on a gaming table. One or more players can be accommodated at the live gaming table and the method of play can allow each player to take one card in turn around the table or each player can complete all of his hands before the dealer moves on to the next player in order around the gaming table.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a poker game using a single deck of cards comprising:

a) a player making a first wager for a first hand and a second wager for a second hand;

b) dealing three cards face up comprising the first hand and dealing three cards face up comprising the second hand;

c) dealing two selection cards, one card face up and one card face down;

d) a player selecting either the face up card or the face down card and the selected card being displayed in the player's first hand as the player's fourth card and removing the non-selected card from play so that the non-selected card is no longer available to be used in the game;

e) dealing two more selection cards, one card face up and one card face down;

f) the player selecting either the face up card or the face down card and the selected card being displayed in the player's second hand as the player's fourth card and removing the non-selected card from play so that the non-selected card is no longer available to be used in the game;

g) dealing two more selection cards, one card face up and one card face down;

h) a player selecting either the face up card or the face down card and the selected card being displayed in the player's first hand as the player's fifth card and removing the non-selected card from play so that the non-selected card is no longer available to be used in the game;

i) dealing two more selection cards, one card face up and one card face down;

j) the player selecting either the face up card or the face down card and the selected card being displayed in the player's second hand as the player's fifth card and removing the non-selected card from play so that the non-selected card is no longer available to be used in the game;

k) determining the poker hand ranking of the player's first hand and paying the player a predetermined amount based on the amount of the first wager if the first hand comprises a preselected poker ranking; and l) determining the poker hand ranking of the player's second hand and paying the player a predetermined amount based on the amount of the second wager if the second hand comprises a preselected poker ranking.

2. The method of claim 1 in which the deck of cards is a standard deck of fifty-two playing cards.

3. The method of claim 1 in which each wager is between one and five coins, tokens or credits.

4. The method of claim 1 in which the amount paid to the player is based on a payout table.

5. The method of claim 4 in which the payout table comprises:

| | NUMBER OF COINS PLAYED | | | | |
|---|---|---|---|---|---|
| POKER HAND RANKING | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 7 | 14 | 21 | 28 | 35 |
| STRAIGHT | 5 | 10 | 15 | 20 | 25 |
| THREE OF A KIND | 3 | 6 | 9 | 12 | 15 |
| TWO PAIR | 2 | 4 | 6 | 8 | 10 |
| JACKS OR BETTER | 1 | 2 | 3 | 4 | 5. |

6. A method of playing a poker game using a single deck of cards comprising:

a) a player making a first wager for a first hand, a second wager for a second hand and a third wager for a third hand;

b) dealing three cards face up comprising the first hand, dealing three cards face up comprising the second hand and dealing three cards face up comprising the third hand;

c) dealing two selection cards, one card face up and one card face down;

d) a player selecting either the face up card or the face down card and the selected card being displayed in the player's first hand as the player's fourth card and removing the non-selected card from play so that the non-selected card is no longer available to be used in the game;

e) dealing two more selection cards, one card face up and one card face down;

f) the player selecting either the face up card or the face down card and the selected card being displayed in the player's second hand as the player's fourth card and removing the non-selected card from play so that the non-selected card is no longer available to be used in the game;

g) dealing two more selection cards, one card face up and one card face down;

h) the player selecting either the face up card or the face down card and the selected card being displayed in the player's third hand as the player's fourth card and removing the non-selected card from play so that the non-selected card is no longer available to be used in the game;

i) dealing two more selection cards, one card face up and one card face down;

j) a player selecting either the face up card or the face down card and the selected card being displayed in the player's first hand as the player's fifth card and removing the non-selected card from play so that the non-selected card is no longer available to be used in the game;

k) dealing two more selection cards, one card face up and one card face down;

l) the player selecting either the face up card or the face down card and the selected card being displayed in the player's second hand as the player's fifth card and removing the non-selected card from play so that the non-selected card is no longer available to be used in the game;

m) dealing two more selection cards, one card face up and one card face down;

n) the player selecting either the face up card or the face down card and the selected card being displayed in the player's third hand as the player's fifth card and removing the non-selected card from play so that the non-selected card is no longer available to be used in the game;

o) determining the poker hand ranking of the player's first hand and paying the player a predetermined amount based on the amount of the first wager if the first hand comprises a preselected poker ranking;

p) determining the poker hand ranking of the player's second hand and paying the player a predetermined amount based on the amount of the second wager if the second hand comprises a preselected poker ranking; and q) determining the poker hand ranking of the player's third hand and paying the player a predetermined amount based on the amount of the third wager if the third hand comprises a preselected poker ranking.

7. The method of claim 6 in which the deck of cards is a standard deck of fifty-two playing cards.

8. The method of claim 6 in which each wager is between one and five coins, tokens or credits.

9. The method of claim 6 in which the amount paid to the player is based on a payout table.

10. The method of claim 9 in which the payout table comprises:

| | NUMBER OF COINS PLAYED | | | | |
|---|---|---|---|---|---|
| POKER HAND RANKING | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 7 | 14 | 21 | 28 | 35 |
| STRAIGHT | 5 | 10 | 15 | 20 | 25 |
| THREE OF A KIND | 3 | 6 | 9 | 12 | 15 |
| TWO PAIR | 2 | 4 | 6 | 8 | 10 |
| JACKS OR BETTER | 1 | 2 | 3 | 4 | 5. |

* * * * *